US005274970A

United States Patent [19]

Roberts

[11] Patent Number: 5,274,970

[45] Date of Patent: Jan. 4, 1994

[54] FREESTANDING PARTITION SYSTEM

[76] Inventor: Raymond P. Roberts, 4307 E. 64th Pl., Tulsa, Okla. 74136

[21] Appl. No.: 864,633

[22] Filed: Apr. 7, 1992

[51] Int. Cl.[5] ..... E04B 5/48

[52] U.S. Cl. ..... 52/126.2; 52/239; 160/135

[58] Field of Search ..... 52/126.2, 126.3, 126.4, 52/36, 238.1, 239, 241, 242, 221; 160/135, 351

[56] References Cited

U.S. PATENT DOCUMENTS

| | | | |
|---|---|---|---|
| 3,416,270 | 12/1968 | McHugh . | |
| 3,766,692 | 10/1973 | Stark et al. | 160/135 |
| 4,031,675 | 6/1977 | Roberts et al. . | |
| 4,038,790 | 8/1977 | Paisley . | |
| 4,118,903 | 10/1978 | Coulthard . | |
| 4,123,879 | 11/1978 | Blodee et al. . | |
| 4,126,978 | 11/1978 | Heller . | |
| 4,187,649 | 2/1980 | Chaffee . | |
| 4,193,233 | 3/1980 | VandenHoek et al. | 52/126.4 |
| 4,197,685 | 4/1980 | Goulish et al. . | |
| 4,269,005 | 5/1981 | Timmons . | |
| 4,356,672 | 11/1982 | Beckman et al. . | |
| 4,438,614 | 3/1984 | Raith et al. . | |
| 4,443,986 | 4/1984 | Propst et al. . | |
| 4,463,531 | 8/1984 | Peretto . | |
| 4,567,698 | 2/1986 | Morrison . | |
| 4,571,906 | 2/1986 | Ashton . | |
| 4,596,098 | 6/1986 | Finkbeiner et al. | 52/239 X |
| 4,606,161 | 8/1986 | Hosoe . | |
| 4,713,920 | 12/1987 | Oginz . | |
| 4,715,158 | 12/1987 | Manzelli . | |
| 4,716,699 | 1/1988 | Crossman et al. | 52/36 X |
| 4,833,848 | 5/1989 | Guerin | 52/238.1 |
| 4,845,907 | 6/1989 | Meek . | |
| 4,995,211 | 2/1991 | Malott . | |

*Primary Examiner*—Carl D. Friedman
*Assistant Examiner*—Kien Nguyen
*Attorney, Agent, or Firm*—Head & Johnson

[57] ABSTRACT

A freestanding partition system including upstanding posts for resting on a floor. At least one rail assembly extends between adjacent posts and is spaced from the floor. Saddles hang from the rail assembly and trays are suspended from the saddles to form raceways. A vertical pole assembly is detachably connected to each post and extends coaxially therewith so that a pair of adjacent pole assemblies and a rail define a panel-receiving space. A panel is supported by the rail and is receivable in the panel-receiving space.

19 Claims, 13 Drawing Sheets

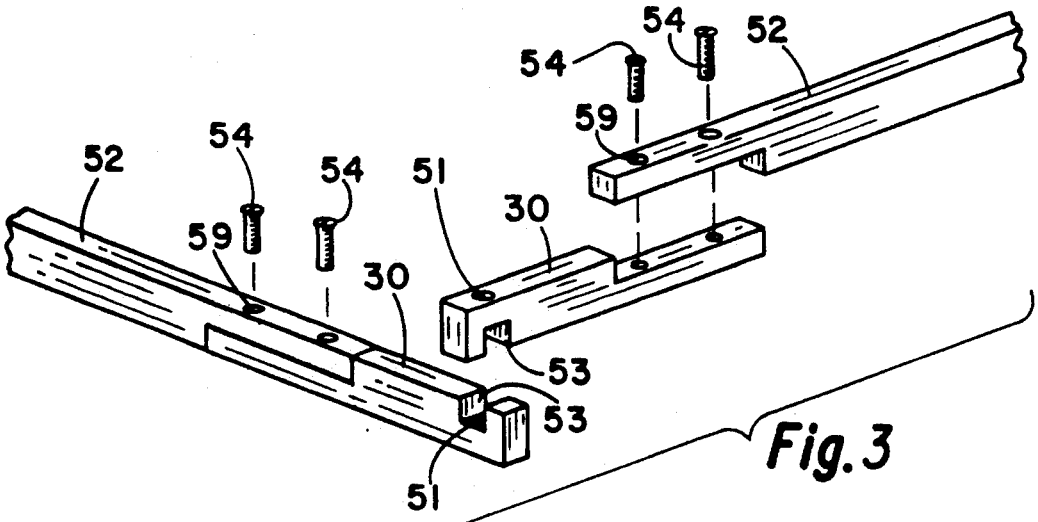
Fig. 3
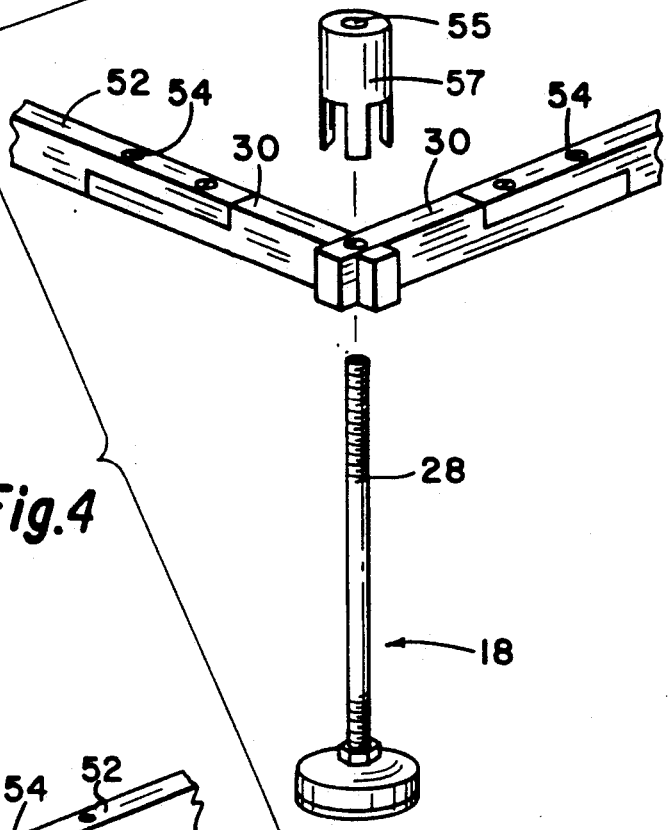
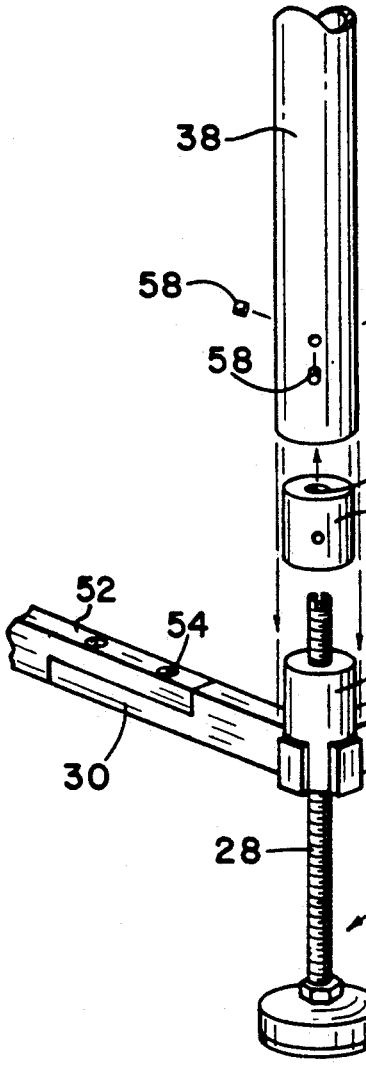
Fig. 4
Fig. 5

FREESTANDING PARTITION SYSTEM

BACKGROUND OF THE INVENTION

1. Field of the Invention

The present invention relates to a freestanding partition system to divide a room into a number of desired spaces. In particular, the present invention relates to a freestanding partition system wherein raceway compartments may be assembled and all wiring completed apart from and prior to installation of any panels.

2. Prior Art

Partitions for use in offices and other environments are desirable in order to divide a large room into a number of work or other areas. Partition systems include modular panels and other elements to construct a partition of any desired arrangement.

Simplicity of installation is a desirable virtue of a partition system.

It is also desirable to be able to install electrical, telephone, computer and other lines within a portion of the partition so that the lines are out of the way and not unsightly.

Roberts et al. (U.S. Pat. No. 4,031,675) discloses one such partition assembly having a lower or basement box which will contain wires and lines.

It is also desirable to have access to the wires or lines after installation of the partition system without having to disassemble or remove the partition components.

Ashton (U.S. Pat. No. 4,571,906) illustrates a partition system having longitudinal service ducts which are accessible by removing the skirtings.

A problem with such systems is that the entire partition system is generally assembled at the time the service ducts are assembled.

In the field, it has been found that several different types of trades are involved which may work on office equipment at various different times. For instance, the electrical lines would be run at one time, the telephone lines will be run at another, and the computer lines run at a third time. When the entire partition system is first assembled prior to any wiring, it requires additional time and expense to work around the partition system.

The panels in the partition systems are covered with a variety of fabrics or other materials. Since office interiors may be changed from time to time, it is desirable to develop a partition system wherein the panel coverings may be readily and simply changed.

A further problem encountered with the existing partition systems is that they are antiseptic-looking and sterile. Additionally, lighting and acoustical problems have arisen.

Accordingly, it is a principal object and purpose of the present invention to provide a freestanding partition system having raceways or duct compartments which may be assembled and installed initially apart from and prior to the panel assembly so that wires and lines can be run without working around the panels.

It is an additional object and purpose of the present invention to provide a freestanding partition system wherein the wiring is contained within the partition system yet is readily accessible.

It is a further object and purpose of the present invention to provide a freestanding partition system having a vertical pole wherein a hanger may be suspended from a slot in the pole for suspension of book shelves, work surfaces and the like.

It is a further object and purpose of the present invention to provide a freestanding partition system that will incorporate containers for plants, light fixtures or acoustical equipment.

It is a further object and purpose of the present invention to provide a partition system wherein the panel coverings may be quickly and simply changed, and where the height, width, length and style of panel may be quickly changed.

SUMMARY OF THE INVENTION

A freestanding partition system is provided in the present invention which includes at least one modular panel assembly. The panel assemblies may be aligned end-to-end in a straight line or may be aligned in angular relationships. The freestanding partition system includes concealed ducts which form raceways for electric, computer and telephone lines. The raceways may be assembled apart from and before the panel assembly is installed.

The partition system is supported on the floor on upstanding posts which extend vertically from the floor. A vertical pole assembly extends coaxially from each upstanding post.

The upstanding post includes a foot and a threaded rod. Threadably connected to the rod is at least one lower connecting bar which has an aperture with internal threads. The connecting bars extend radially from the rod so that it will be substantially horizontal and spaced from the floor. Each connecting bar will connect to a rail by screws or other fasteners. A continuous rail will thus be formed between adjacent posts parallel to and spaced from the floor.

Hanging from the rail are a number of saddles. Each saddle extends from the rail downward to the floor. Suspended from the saddles are trays which are substantially perpendicular to the upstanding posts. The trays will be used to receive the various wires and lines to be installed in the raceway.

Panel brackets are suspended from the rail. The panels themselves may secured directly to panel brackets or may be secured to panel clips which mate with the panel brackets.

In order to assemble the raceway, a pair of lower connecting bars would interlock so that an aperture in each connecting bar is aligned. Each lower connecting bar may have a notched interlock with the adjoining bar. Once a rail has been connected between adjacent lower connecting bars, the lower connecting bars will next be connected to the threaded rod of the upstanding post. This connection also provides a levelling mechanism for the rail. A cylindrical key member next slips over the junction of the connecting bars. The key member has an opening which receives the threaded end of the post.

A number of saddles will next be hung over and suspended from the rails and the connecting bars. Each saddle receives the trays. These trays form the ducts in which the electrical, telephone, computer and other lines may be installed. Hingeably connected to each saddle are cover plates.

Following completion of the raceways, the vertical pole assembly may be attached. A cylindrical lower tree lock has a threaded opening which is connected to the threaded rod. A vertical pole has a lower end which is cylindrical. The vertical pole has an interior diameter larger than the outside diameter of the tree lock so that the vertical pole fits over the tree lock. The vertical pole may be secured to the key lock by screws or other fasteners.

To install the upper rail assembly, an upper tree lock member will be received in the top of the vertical pole. Upper connecting bars will interlock so that apertures will be aligned. A threaded bolt retains the upper connecting bars and key member together. Each upper connecting bar would be connected with an upper rail so that a continuous support rail is formed by the upper connecting bars and the intermediate rail.

The upper tree lock would be received within the portion of the vertical pole. These can be secured together by screws or other fasteners.

The panel brackets may then be suspended from the rails and connecting bars after which the panels may be secured to the panel brackets.

BRIEF DESCRIPTION OF THE DRAWINGS

FIGS. 3, 4, 5, 6, 7, and 8 are exploded views illustrating the sequential assembly of the raceway of the freestanding partition system as shown in FIG. 1;

DETAILED DESCRIPTION OF THE PREFERRED EMBODIMENTS

Figure 1:
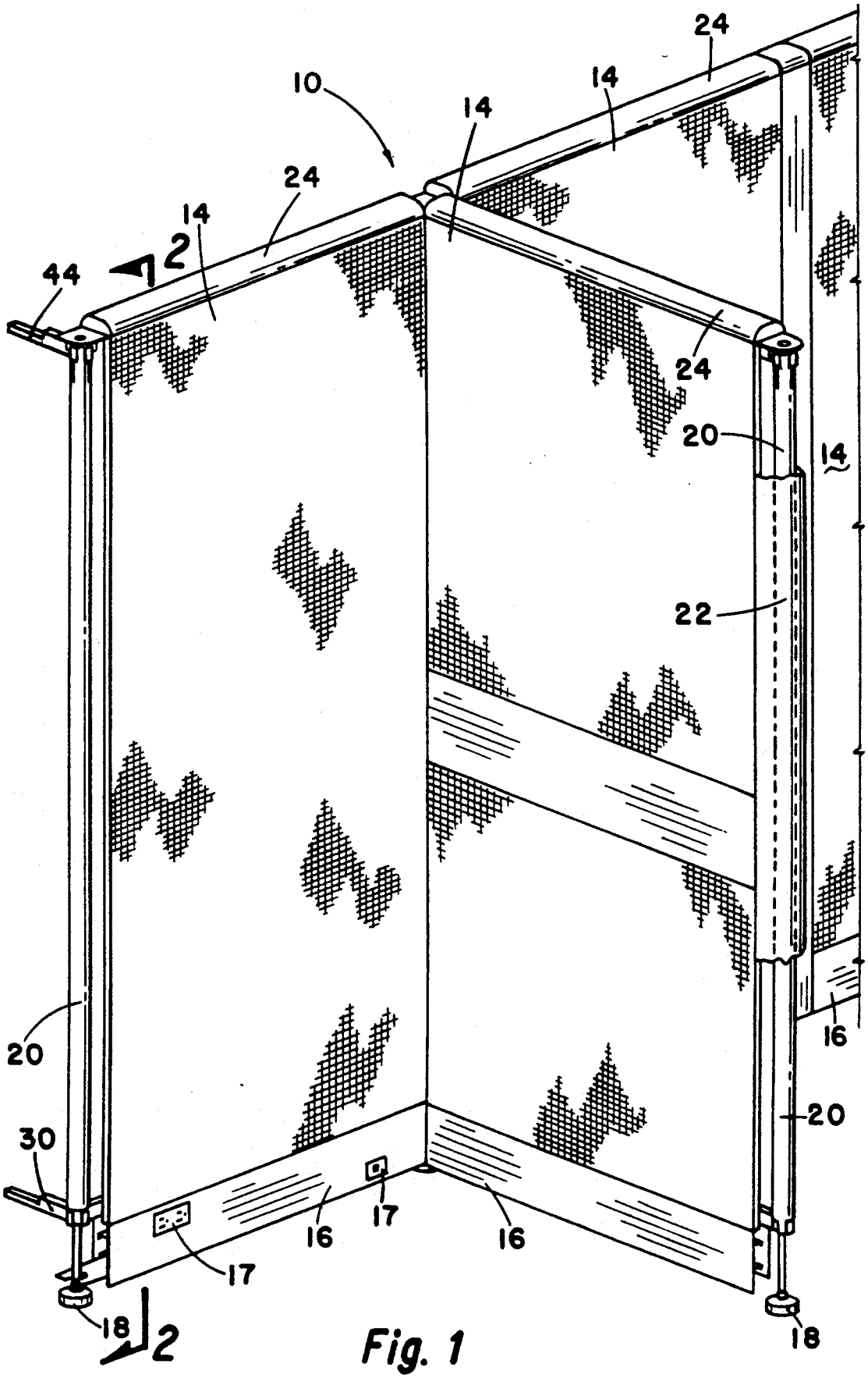
FIG. 1 is a perspective view of a freestanding partition system constructed in accordance with the present invention having portions cut-away for clarity.

Referring to the drawings in detail, FIG. 1 is a perspective view of one embodiment of a freestanding partition system 10 constructed in accordance with the present invention. The partition system 10 can be used for a variety of purposes but is ideally suited to create an office layout which is flexible in design and can be tailored to the needs of the individual business.

As is common with freestanding partition systems, it may be assembled within a larger room to provide an almost infinite number of layouts. Since the partition system 10 is modular, it may be reconfigured at a later time into different arrangements.

As will be described in detail herein, several of the elements of the partition system 10 are shown cut-away in FIG. 1 for ease of comprehension.

The freestanding partition system 10 includes at least one modular panel assembly 14, although a typical system includes a number of modular panel assemblies connected end-to-end.

The panel assemblies, which will be vertical to the floor when installed, may be aligned end-to-end in a straight line or they may be aligned in angular relation. The panel assemblies 14 which are visible in FIG. 1 combine both arrangements to form a "T." It will be appreciated that other arrangements, such as an "X" or "L" are also possible.

The modern office requires electric, telephone and other service which is delivered by cables or lines. An important feature of the present system is the provision of concealed ducts which form raceways 16 for electric, computer, telephone and other lines. Each panel assembly 14 has a corresponding raceway 16 so that when the partition system is assembled, the ducts allow lines to be brought to any location. The raceways 16 may include outlets 17 so that electrical, telephone and other service is brought directly to a desired location. The equipment, such as telephones and computers (not shown), may then be plugged into the outlets 17. This eliminates unsightly and unsafe lines on the floor.

An important advantage of the present system is that the raceways 16 may be assembled before the panel assemblies 14 are installed. It is thus possible to install all of the electrical, telephone, computer and other lines before and apart from installation of any of the panels. At the same time, additional or different lines may be added and installed in the raceways without interference or disassembly of the panel assemblies. It will also be seen that the panels themselves may be changed without disassembly of the entire partition system 10 so that the height of the partition system may be varied.

The system 10 is supported on a floor(not shown) on upstanding posts 18, including an appropriate foot, which will rest on the floor. The upstanding posts 18 extend vertically from the floor. As will be seen, the upstanding posts extend only a short portion of the total vertical height of the partition system 10.

A vertical pole assembly 20 extends coaxially from each upstanding post 18. The vertical pole assembly 20 will not be visible upon completion of the installation but may be covered by an end cap 22, a portion of which has been cut-away in FIG. 1.

At the top of each panel assembly 14, a decorative trim cap or top molding 24 may be affixed. The trim caps or top moldings are not a structural part of the present invention and, accordingly, can be quickly and inexpensively changed locally or by the user.

Figure 2:
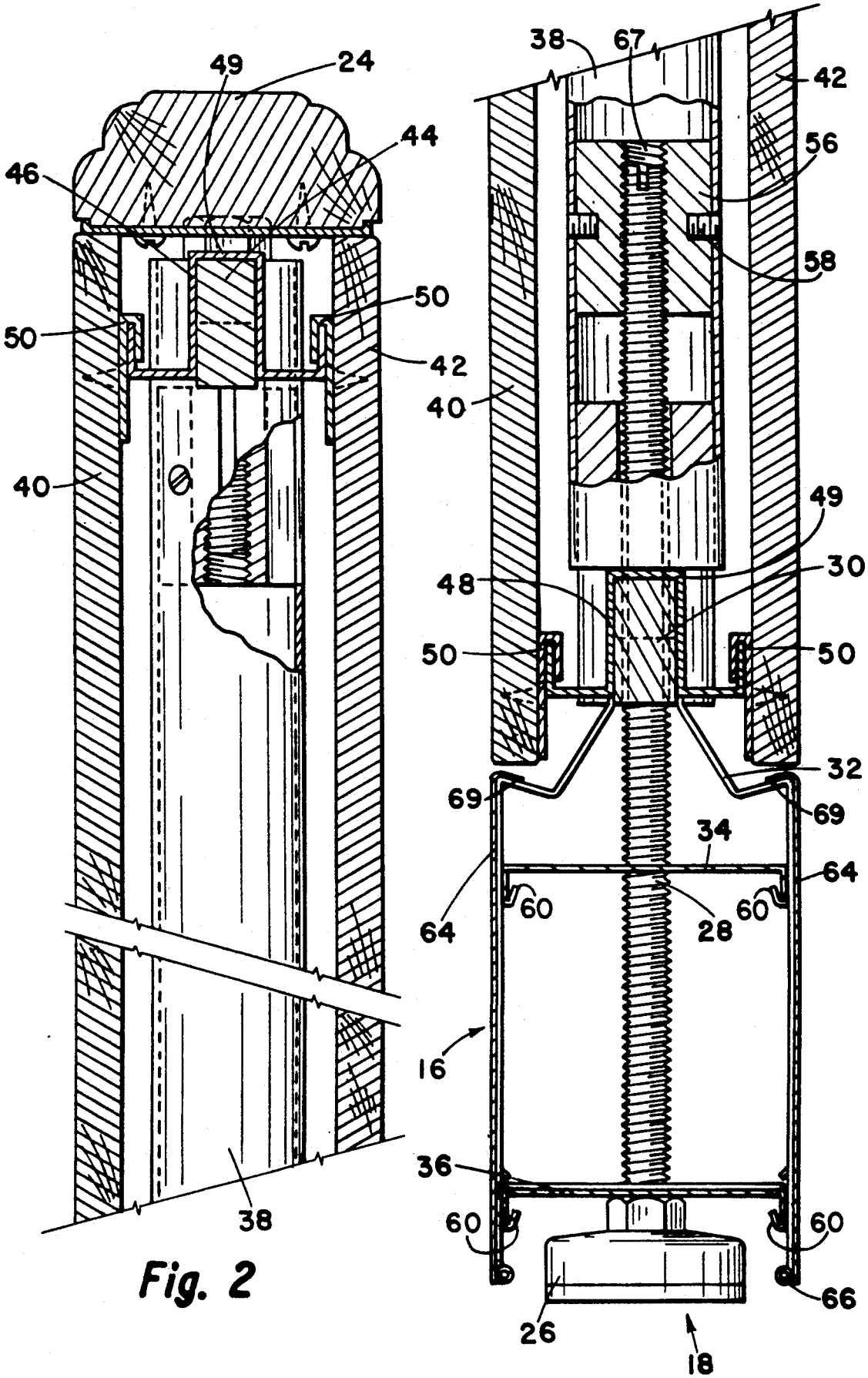
FIG. 2 is a sectional view of the freestanding partition system taken along section lines 2—2 of FIG. 1.

FIG. 2 illustrates a sectional view taken along section line 2—2 of FIG. 1. Each upstanding post 18 includes a foot 26 and a threaded rod 28. Threadably connected to the rod 28 is at least one lower connecting bar 30 (seen in cross-section in FIG. 2). The lower connecting bar 30 has an aperture (not seen in FIG. 2) having internal threads. The lower connecting bar 30 extends radially from the rod 28 so that it will be substantially horizontal to the floor (not shown).

The lower connecting bar 30 will also be spaced from the floor. While not visible in FIG. 2, each lower connecting bar 30 will be attached to a rail to form a continuous rail extending the length of the panel assembly. Hanging from the connecting bar 30 is a saddle 32, one of which is visible in FIG. 2. The saddle 32 fits over and extends from the connecting bar downward toward the floor. Each saddle includes a "U" shaped portion that fits over the lower connecting bar. In a typical installation, several saddles 32 will be spaced along the rail.

Suspended from the saddles 32 are a number of trays 34 and 36 which are substantially perpendicular to the upstanding posts 18. The trays form a pair of parallel raceway ducts and will be utilized to receive the various wires to be installed in the raceway 16.

A portion of the vertical pole assembly 20 is also visible in FIG. 2. Extending coaxially from each upstanding post 18 is a vertical pole 38 which is detachably connected to the upstanding post. It will be noted that the vertical pole 38 need not be attached for installation of the raceways 16. It is thus possible to install all wiring beforehand. The vertical pole will only be necessary for installation of the panel assembly 14.

FIG. 2 illustrates one type of modular panel assembly 14 that may be used with the present invention. The panel assembly 14 seen in FIG. 2 actually comprises two separate panels 40 and 42, spaced from and parallel to each other. The panels 40 and 42 form the outer surface of the panel assembly.

Upper panel brackets 46 are suspended from upper connecting bar 44 while lower panel brackets 48 are suspended from lower connecting bar 30. Each panel bracket 46 and 48 has a "U" shaped portion 49 that fits over its respective connecting bar. The panels 40 and 42 may be secured directly to the panel brackets or, alternatively, as seen in FIG. 2, may be secured to panel clips 50 which mate with the panel brackets 46 and 48.

FIGS. 3, 4, 5, 6, and 7 are exploded views illustrating sequential assembly of the raceways 16 for a partition system 10 forming a right angle or "L" shaped arrangement.

FIGS. 3, 4, 5, 6 and 7 are in sequential order to illustrate one assembly. FIG. 3 shows an exploded view wherein a pair of lower connecting bars 30 would interlock so that a threaded aperture 51 in each lower connecting bar is aligned. Each lower connecting bar 30 has a notch 53 to interlock with the notch 53 on an adjoining connecting bar.

Each lower connecting bar will be connected to a lower rail 52 by screws 54 or other fastening means. Each screw 54 is received through a threaded opening 59 in the lower rail and a threaded opening 61 in the lower connecting bar. A continuous rail will thus be formed between adjacent posts 18 parallel to and spaced from the floor. As will be described herein, this rail forms the entire support structure for the raceways 16.

FIG. 4 illustrates the next step in the sequence of assembly of the raceways 16. The lower connecting bars 30 are connected with the threaded rod 28 of the upstanding post 18 through threaded apertures 51. This connection also provides a levelling mechanism for the rail. Rotating the threaded rod 28 clockwise will lower the lower connecting bars and rail 52. Conversely, rotating the threaded rod 28 counter-clockwise will raise the connecting bars. The system thus is capable of adjusting to uneven floors or other irregularities.

A cylindrical key member 57 having extending fingers slips over the junction of the connecting bars 30. The key member 57 has an opening 55 which receives the threaded end 28 of the post 18.

At this point, the balance of the raceways 16 may be assembled and this will be a preferred sequence of assembly. Alternatively, as seen in FIG. 5, the vertical pole assembly 20 may be attached. A cylindrical lower tree lock 56 has a threaded opening 67 which is connected with the threaded rod 28. The vertical pole 38 has a lower cylindrical open end. The vertical pole has an interior diameter larger than the outside diameter of the tree lock 56 so that the vertical pole fits over the tree lock. The vertical pole 38 may be secured to the tree lock 56 by screws 58 or other fasteners.

Figure 6:
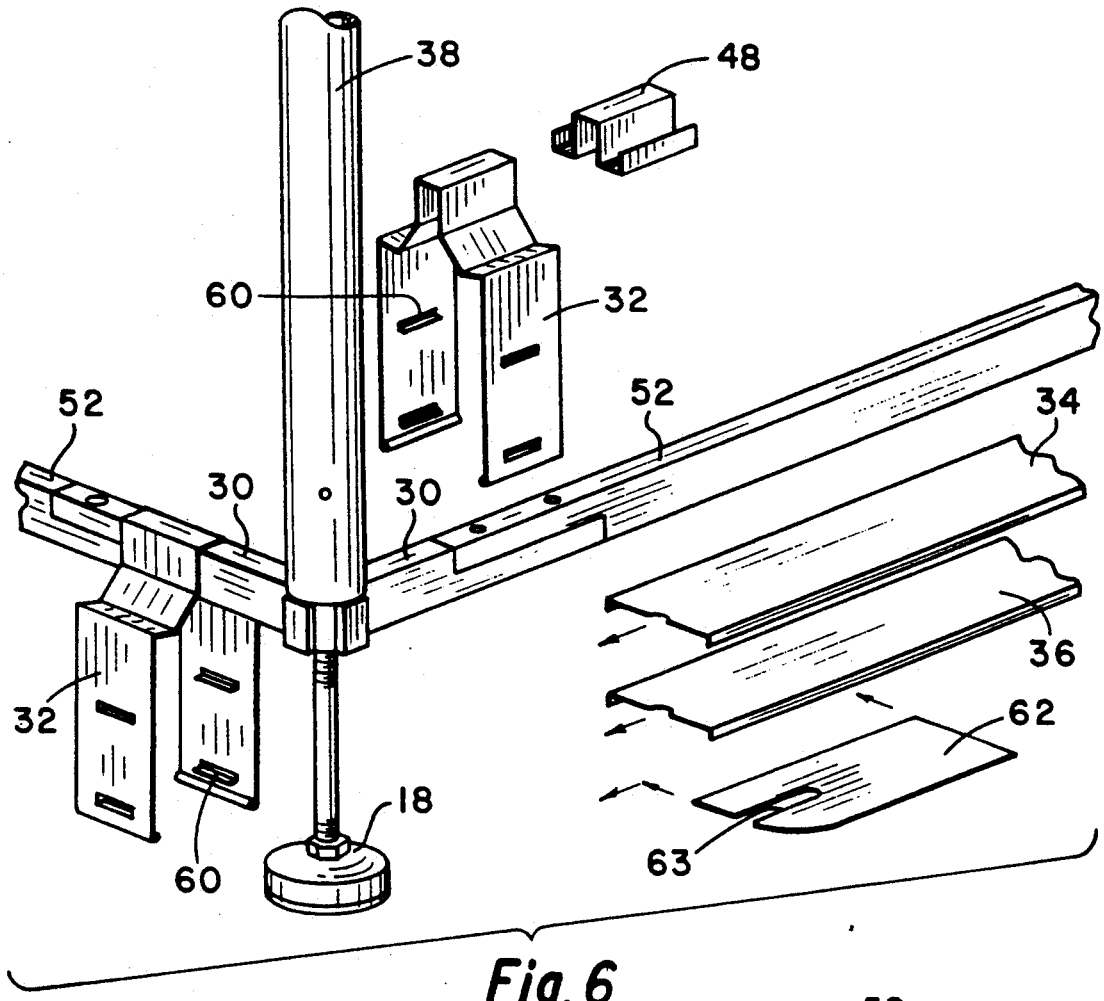

FIG. 6 illustrates the next step in the installation sequence of the raceways 16. A number of saddles 32 will be hung over and suspended from the rails 52 and connecting bars 30 at intervals. It has been found that no fasteners are required to secure the saddles 32 to the rails.

In one embodiment, each saddle 32 has a number of lips 60 which will receive the trays 34 and 36. As seen in FIG. 6 and also in FIG. 2, these lips may be punched out from the saddles to form pairs of lips that are opposed to each other. In an alternate embodiment, the trays 34 and 36 may be welded or otherwise permanently secured to the saddles.

These trays 34 and 36 form the ducts in which the electrical, telephone, computer and other lines may be installed. Provision of a pair of ducts will allow the high voltage lines, such as electrical service, to be placed in one duct with the low voltage lines, such as telephone service, in the other duct.

At the connection of the various raceways 16 at the posts 18, a junction plate 62 may be aligned with the tray 36 to complete the raceways around the corner. The junction plate 62 may have a notch 63 to fit around the post 18. In the embodiment shown, the junction plate may simply be installed by resting on the tray 36 and the foot 26. In an alternate embodiment, the junction plate 62 may slidably extend from a track (not shown) beneath tray 36.

Figure 7:
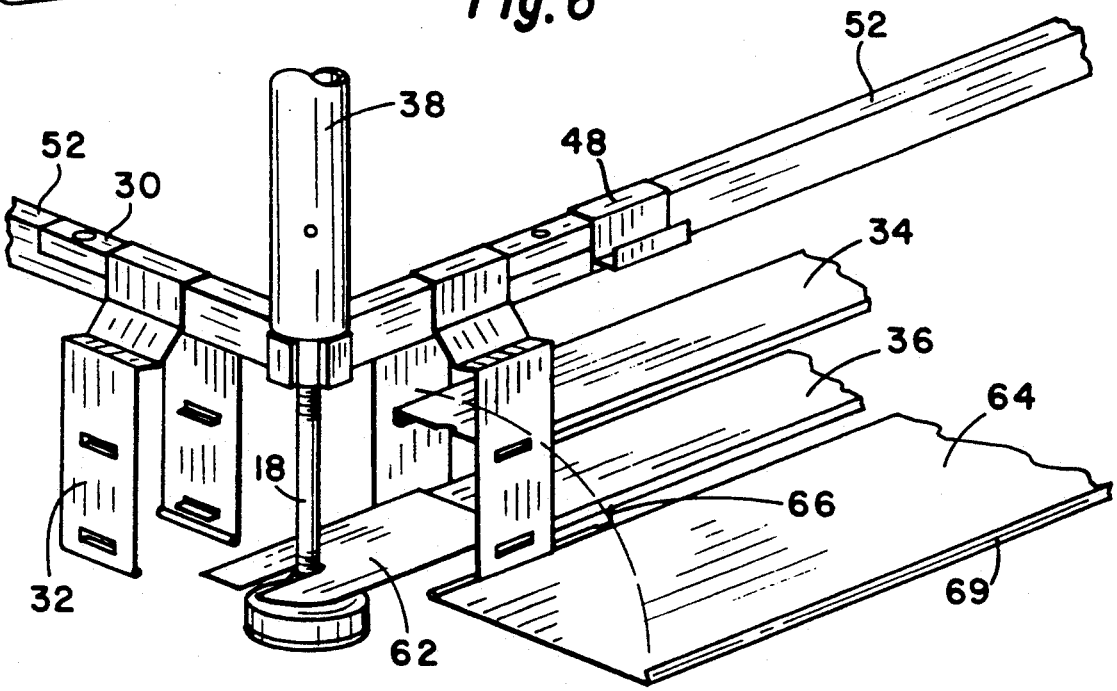

In FIG. 7, the junction plate 62, tray 34 and tray 36 are shown installed and in place. It will be observed that the width of the raceways 16 may also be adjusted if desired. This may be easily accomplished by replacing the saddles 32, trays 34 and 36 and junction plates 62. This might be desirable for aesthetic reasons or because greater wiring capacity is desired. Hingeably connected to each saddle 32 is a cover plate 64.

With continuing reference to FIG. 7 and further reference to FIG. 2, the cover plate 64 may be connected to the saddle by hinge pins 66. The cover plate may have a resilient edge 69 for a snap fit connection with the saddles 32. In the closed position, each cover plate 64 is parallel to and flush with the exterior of the modular panel assembly 14. The closed position may be observed in FIG. 2. In the fully open position, the cover plate 64 is substantially perpendicular to the modular panel assembly. Each side of the raceway 16 is, thus, accessible by swinging the cover plate 64 to the open position, as seen in FIG. 7.

At this stage, the assembly of the raceways 16 is complete.

The lower panel bracket 48 may then be placed over and suspended from the rail 52. No fasteners are required to secure the panel bracket 48 to the rail 52.

Figure 8:
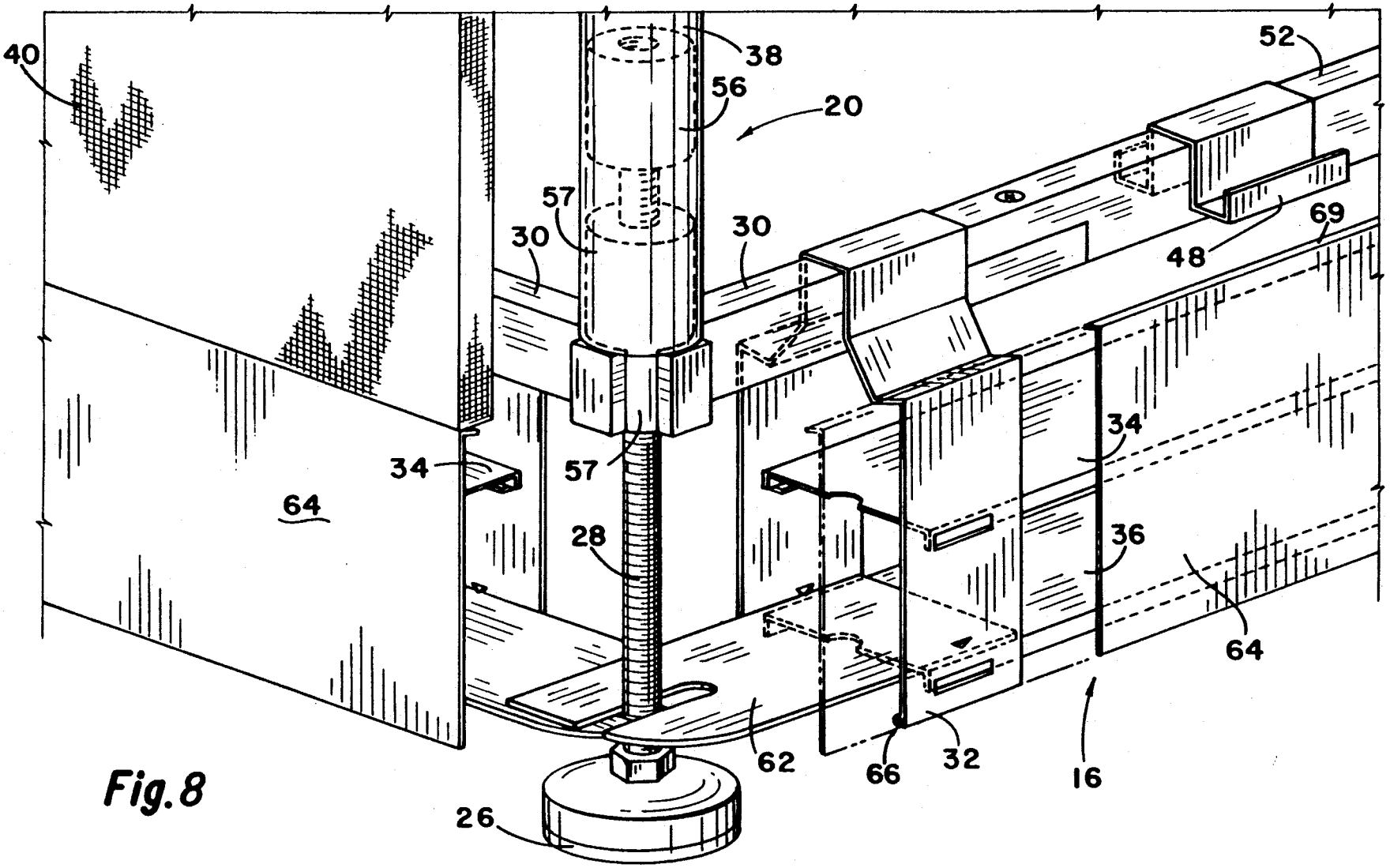

FIG. 8 illustrates the completed raceway along with the vertical pole assembly 20. Outlets 17 (not shown in FIG. 8) may be installed at the time of assembly or would be provided in the cover plate 64. The electric, telephone and other service is thus brought directly to the desired location.

Figures 9, 10:
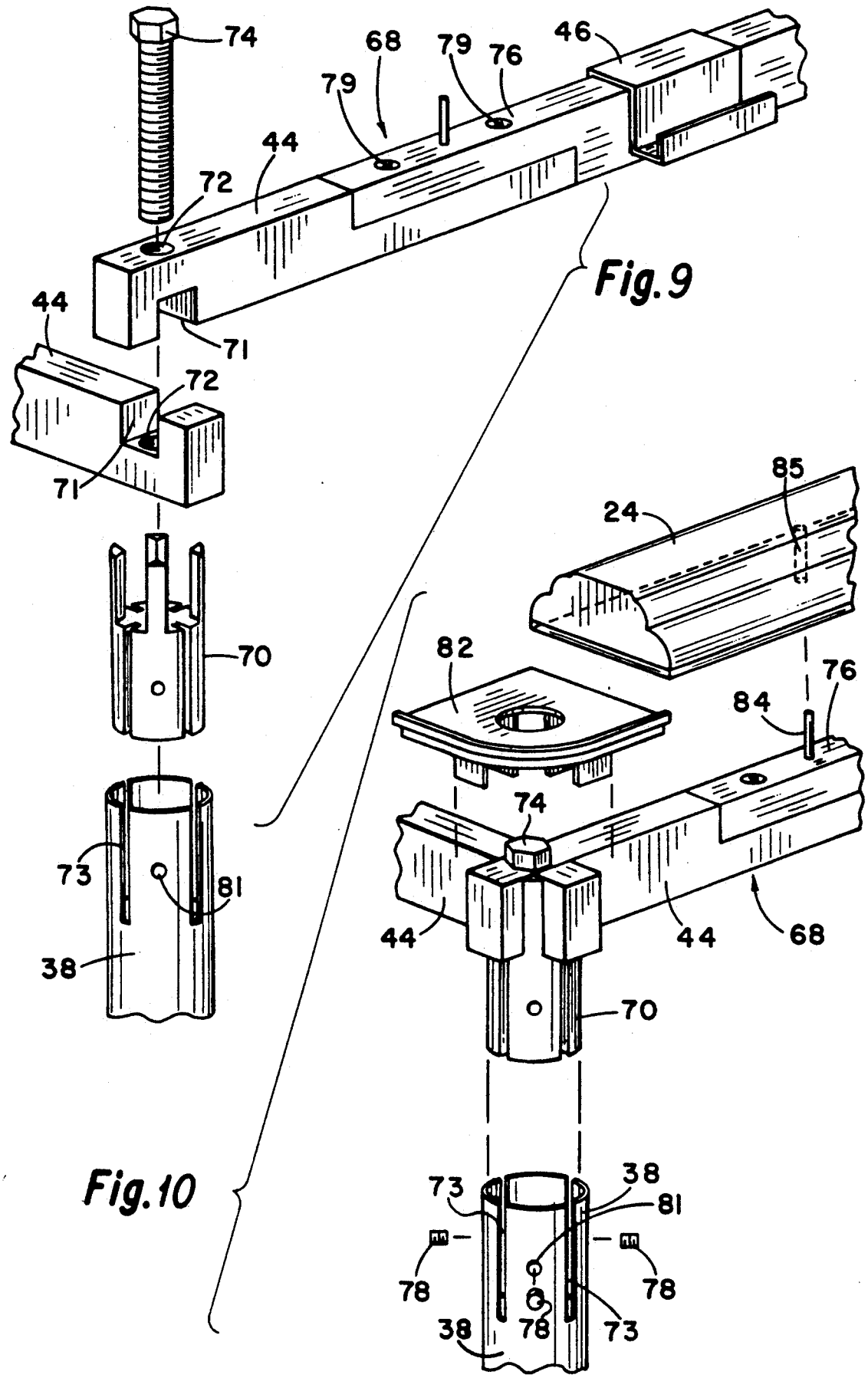
FIGS. 9, 10 and 11 illustrate the sequential assembly of the upper rail assembly of the freestanding partition system shown in FIG. 1.
Figure 11:
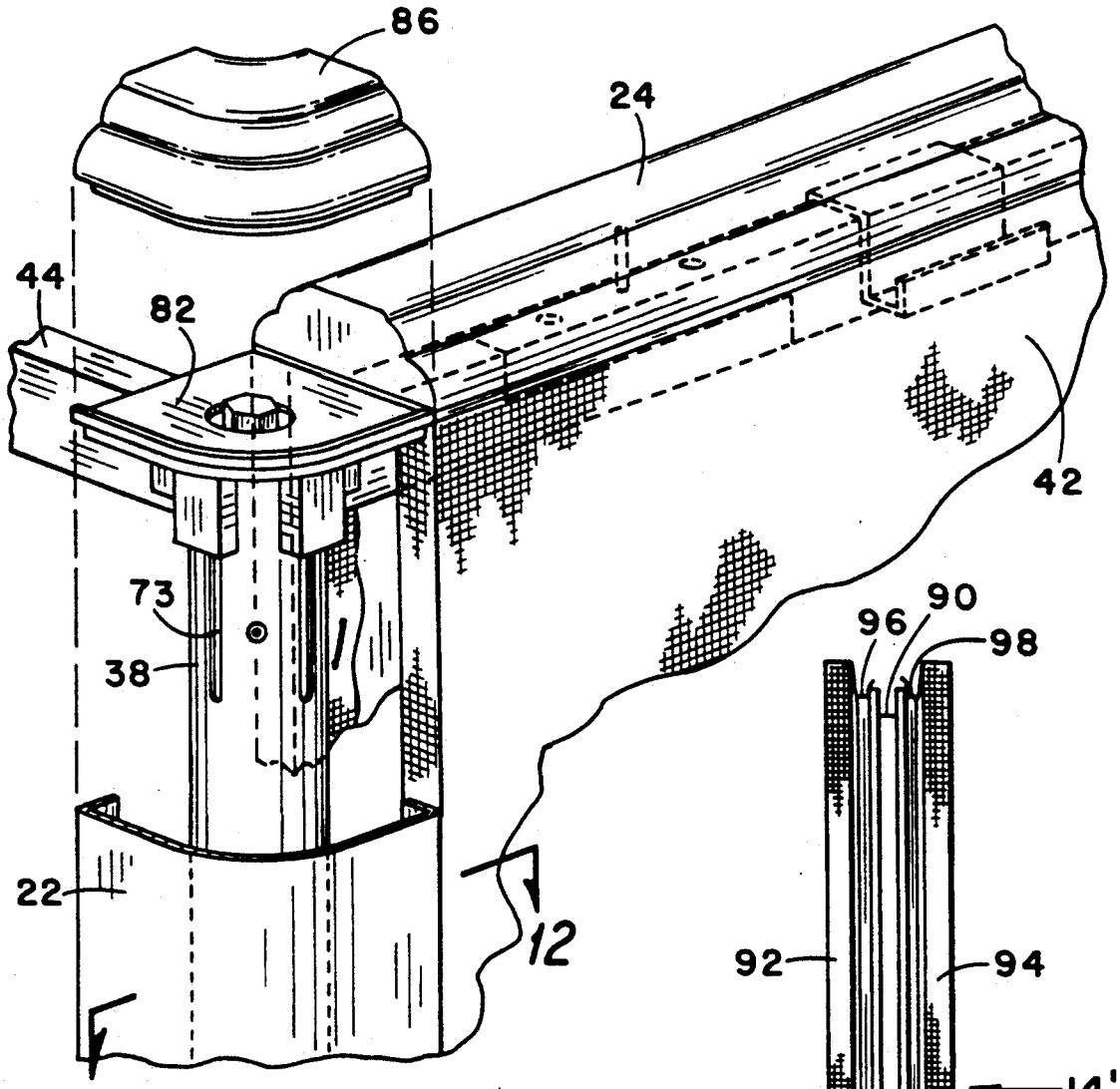

FIGS. 9, 10, and 11 illustrate the sequence for installation of an upper rail assembly 68. The top of the vertical pole 38 has an open end in which will be received an upper tree lock member 70. The open end of the vertical pole has a diameter larger than the diameter of the upper tree lock member 70 so that the vertical pole fits over the tree lock.

Both the vertical pole 38 and the upper tree lock 70 have slots 73 which are aligned when installed. The slots will be used to suspend a hanger (not seen in FIGS. 9, 10 or 11) which will be described in detail.

Each upper connecting bar 44 has a notch 71 to interlock with the adjoining connecting bar 44. The connecting bars may form a straight line or a 90° angle. The upper connecting bars 44 will interlock so that apertures 72 therein will be aligned. A threaded bolt 74 retains the upper connecting bars 44 and the key member 70 together.

As with the lower connecting bars 30 and rails 52, each upper connecting bar 44 would be connected with an upper rail 76. Each rail 76 is aligned with the bar 44. They would be secured by screws 79. A continuous support rail is thus formed by the upper connecting bars 44 and upper rail 76.

An upper panel bracket 46 would be suspended from the upper rail. The panel bracket has an upper "U" shaped portion to fit over the rail 76.

Turning to FIG. 10, the upper tree lock 70 would be received within the top portion of the vertical pole 38. These can be secured together by screws 78 or other fasteners which pass through openings 81 in the vertical pole.

A top cap 82 having downwardly extending fingers 83 may be placed over the bolt 74 and over interlocked upper connecting bars 44.

The top molding 24 may be provided with a recess 85 (shown by dashed lines) on its bottom edge to mate with an optional protruding pin 84 extending from the upper rail 76.

Figure 12:
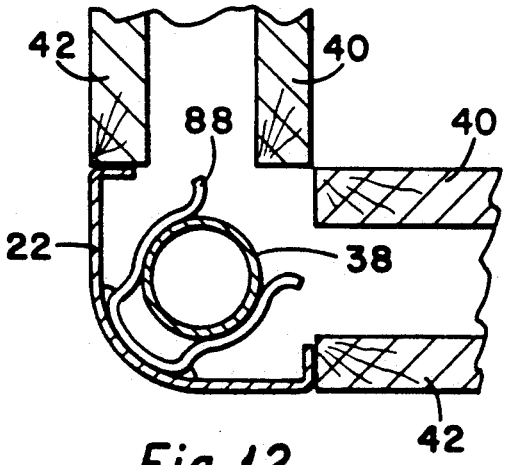
FIG. 12 is a sectional view taken along section line 12—12 of FIG. 11.

FIG. 11 illustrates the final steps in the sequence of the upper rail assembly 68. Once the panels 40 and 42 have been installed, a corner molding 86 may be placed on the top cap 82. The corner molding 86 may be fastened to the top cap 82 although this has not been found to be necessary. Additionally, the end cap 22 may be secured to the vertical pole 38 by a clamp or other mechanism. FIG. 12 is a cross-sectional view taken along section line 12—12 of FIG. 11. The end cap may be secured to the vertical pole 38 by a slip-on clamp 88. Since they are not structural components of the freestanding partition system, it will be appreciated that the decorative top molding 24 and the corner molding 86 may be changed as desired to suit the decor and design of the interior space. Likewise, the end cap 22 may be changed as desired.

Figure 13:
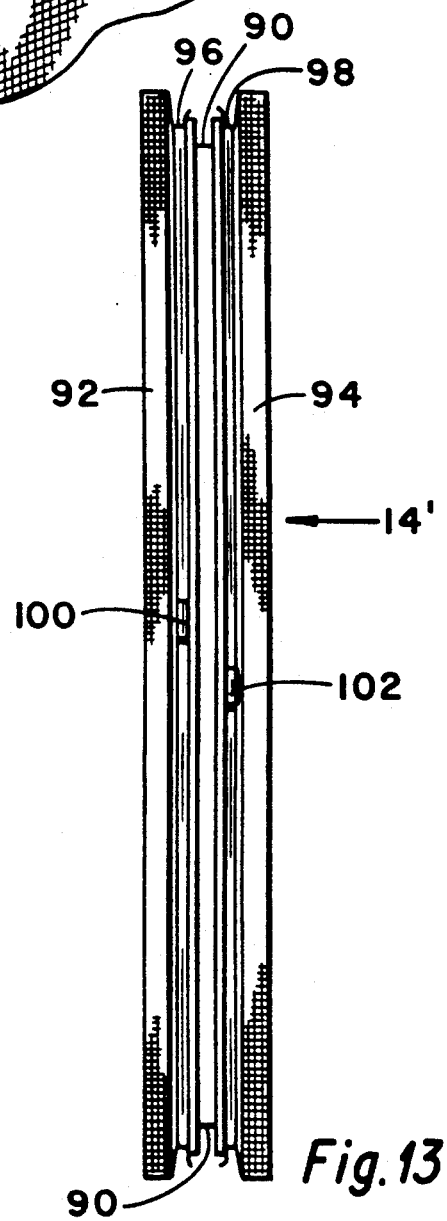
FIG. 13 is a side view of an alternate panel assembly for use with the freestanding partition system shown in FIG. 1.

FIG. 13 illustrates an alternate modular panel assembly 14'. Instead of utilizing a pair of parallel panels suspended from panel brackets 46, the modular panel assembly 14' would be of a one-piece construction having a channel 90 along each edge. On the bottom edge, the channel 90 would mate with the lower rail 52 (not seen in FIG. 13). On the top edge, the channel 90 would mate with the upper rail 76. On the side edges, the channel would mate with the upstanding vertical poles 38. Use of the alternate modular panel assembly 14' would eliminate the need for the panel brackets 46 and 48 and panel clips 50. The alternate modular panel assembly 14' may be fully insulated and is more rigid than the modular panel assembly 14.

A salient feature of the modular panel assembly 14' shown in FIG. 13 is that the panel surfaces 92 and 94 are covered with a fabric or other material that is easily replaceable. The edges of the fabric would be placed in recessed grooves 96 and 98, respectively, about the edges 90 of the panel assembly. A pair of bands 100 and 102, respectively, would fit in the grooves and hold the fabric tight against the panel assembly. Each band will be capable of being tightened or untightened on the site. With this arrangement, the fabric could be chosen for the particular interior and would be readily changeable when the interior decor was changed. An additional advantage is that the fabric or other material could be installed or changed at the site.

Figure 14:
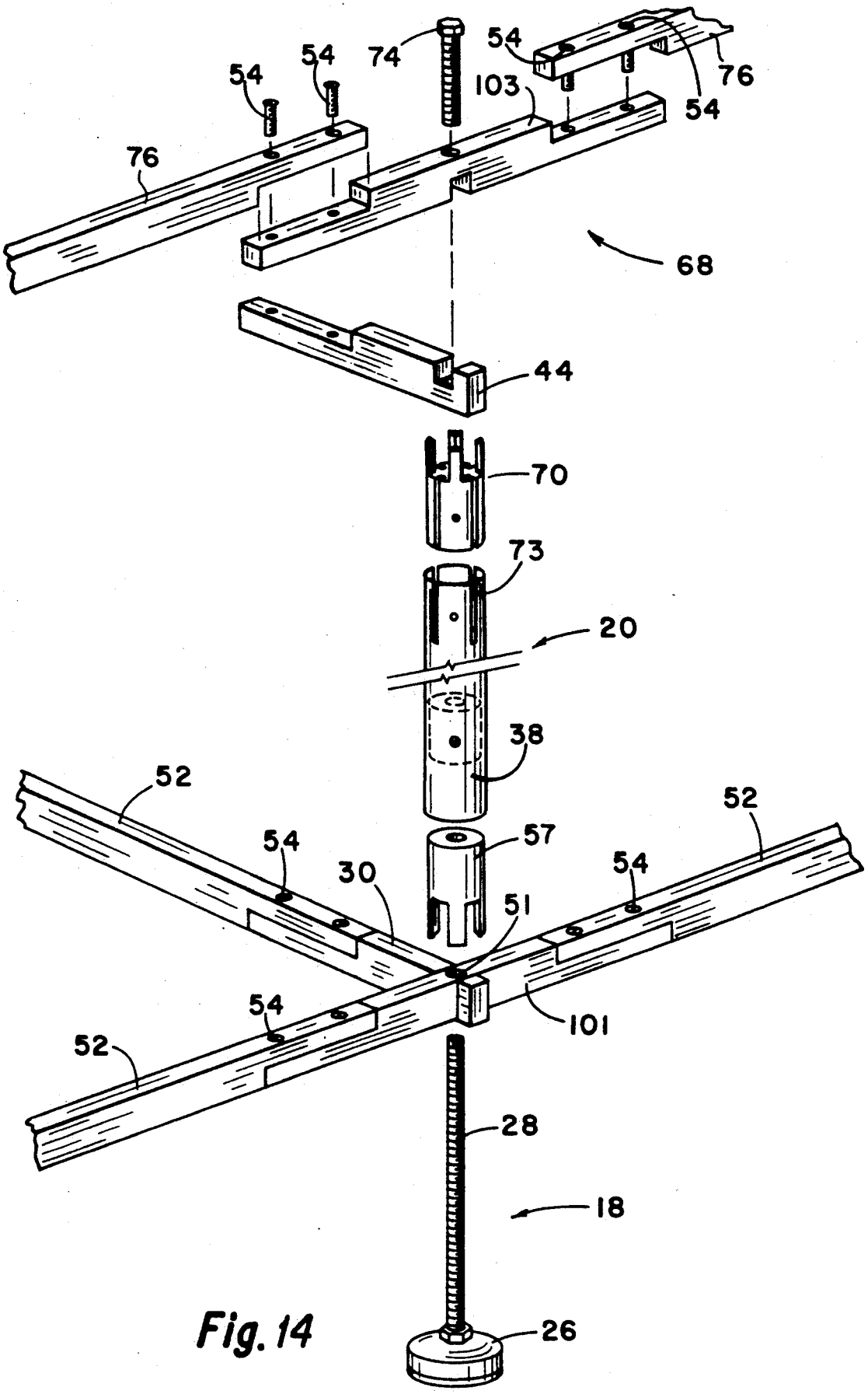
FIG. 14 is an exploded view of the lower rail and upper rail assembly for the freestanding partition system as shown in FIG. 1 for construction of a "T" arrangement.

FIG. 14 illustrates an exploded view of the lower rail 52 and upper rail assembly 68 to form an arrangement to form a "T" (the completed assembly may be seen in FIG. 1). An additional straight lower connecting bar 101 and an additional straight upper connecting bar 103 are the only additional elements required to make this connection. In order to assemble, a lower rail 52 would be attached to each end of the straight lower connecting bar 101 through use of screws 54. A lower rail 52 would also be attached to the end of the lower connecting bar 30 through use of screws 54.

The notch on the lower connecting bar 30 will interlock with the notch on the straight lower connecting bar 101. The threaded rod 28 of the upstanding post 18 will then be connected through threaded aperture 51. The key member 57 fits over this arrangement as in the previously described arrangement. The balance of the assembly would be as previously described.

FIGS. 15 through 20 illustrate another option feature of the freestanding partition system 10. Book shelves, work surfaces and storage units are not only normal to offices but are often required. In the present invention, bookshelves, work surfaces, storage units and the like may be hung from the partition system 10 without a visible, unsightly row of slots at every panel joint.

Figure 15:
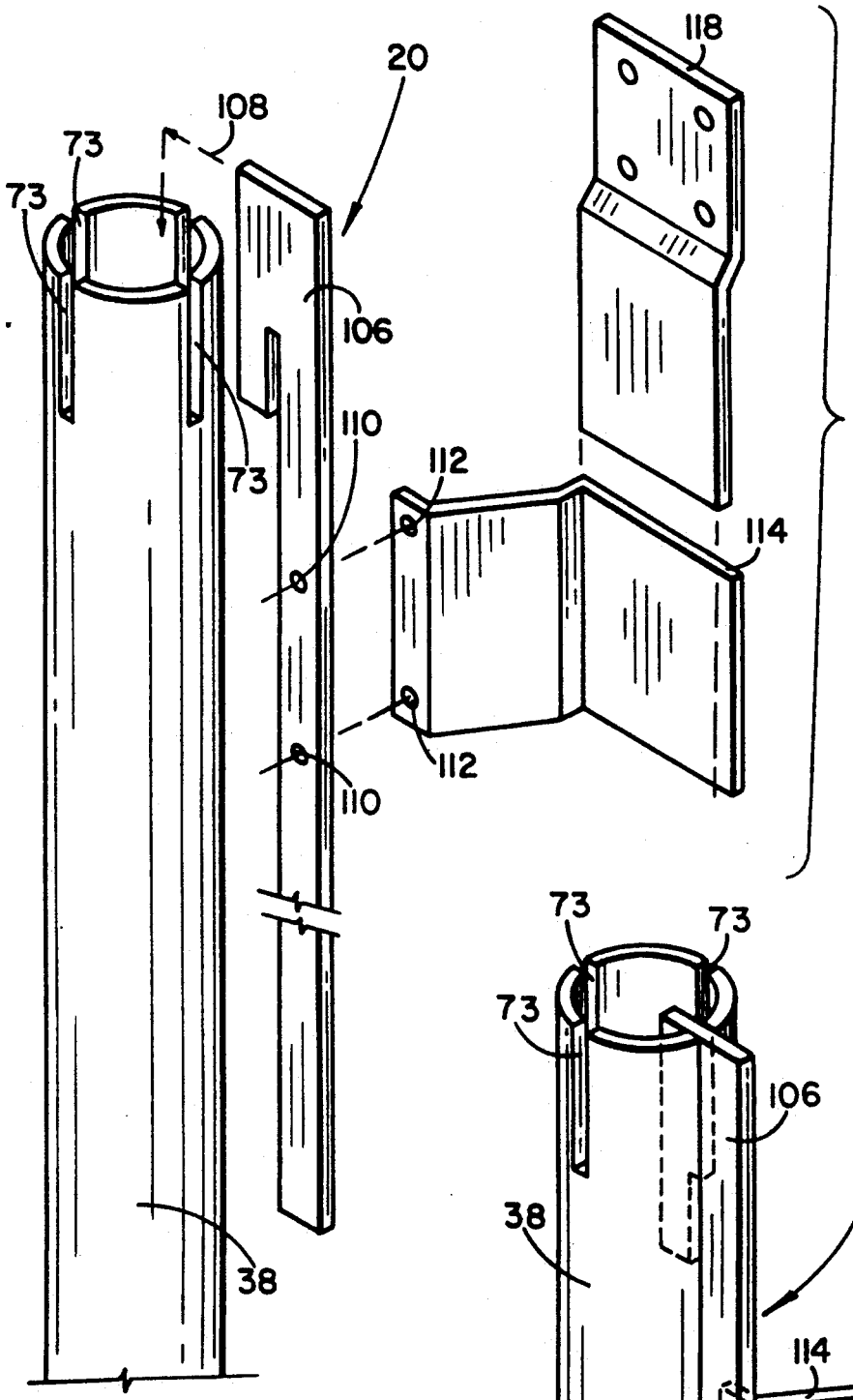
FIGS. 15, 16 and 17 show the use of a hanger and bracket suspended from a vertical pole assembly of the freestanding partition system shown in FIG. 1.

FIG. 15 illustrates an exploded view of the top of the vertical pole assembly 20. A hanger 106 will fit within one of the slots 73 in the vertical pole 38 as shown by the arrows 108. The hanger 106 will, thus, be suspended from the vertical pole without fasteners or other connection mechanism. The length of the hanger is a matter of choice depending on the desired height of the object to be suspended. The hanger and slot arrangement has been found to be efficient and inexpensive. The vertical pole 38 need only be cut in a number of places along the top end to form the slots.

Figure 16:
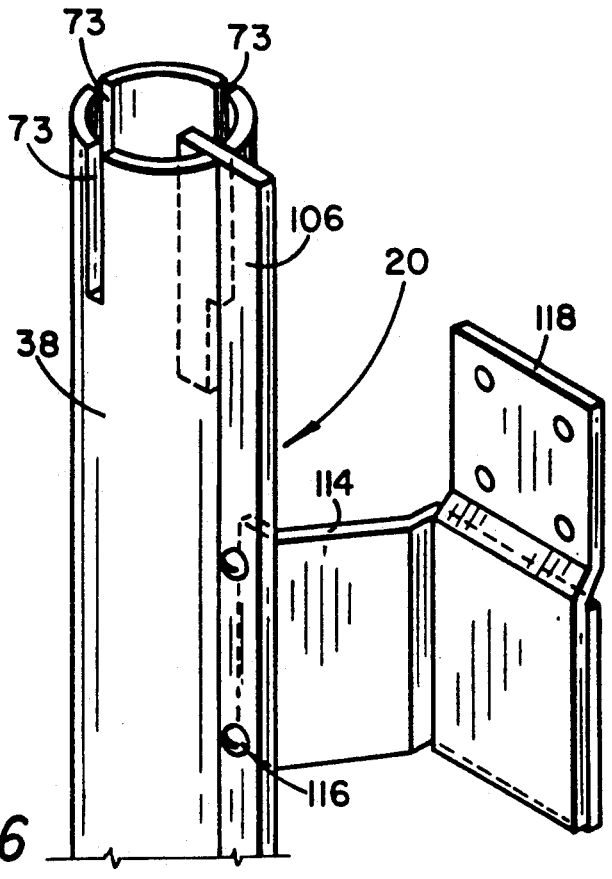

FIG. 16 shows the hanger 106 installed in slot 73. The hanger, once installed, extends axially along the outside of the vertical pole 38. The hanger bracket is attached to the hanger 106 by bolts 116 and nuts 117 or other fasteners. The hanger bracket extends radially out from the vertical pole.

Figure 17:
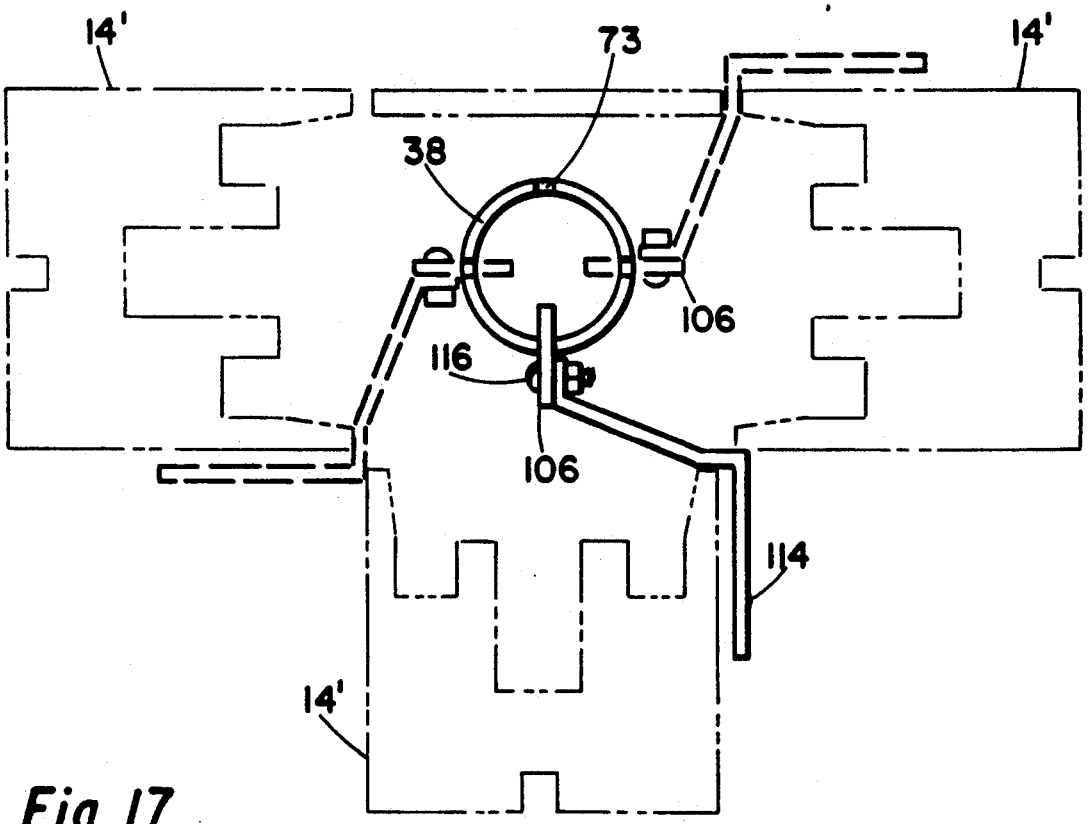

FIG. 17 illustrates the use of the hanger and bracket 114 when assembled. The hanger bracket 114 extends out between the joints of the panel assemblies (not in dashed lines in FIG. 17). A tongue 118 (seen in FIGS. 15 and 16) may thus be received in a space which is formed between the hanger 114 and the surface of the panel assembly 14 or 14'. The tongue would extend from the equipment to be suspended.

Figure 18:
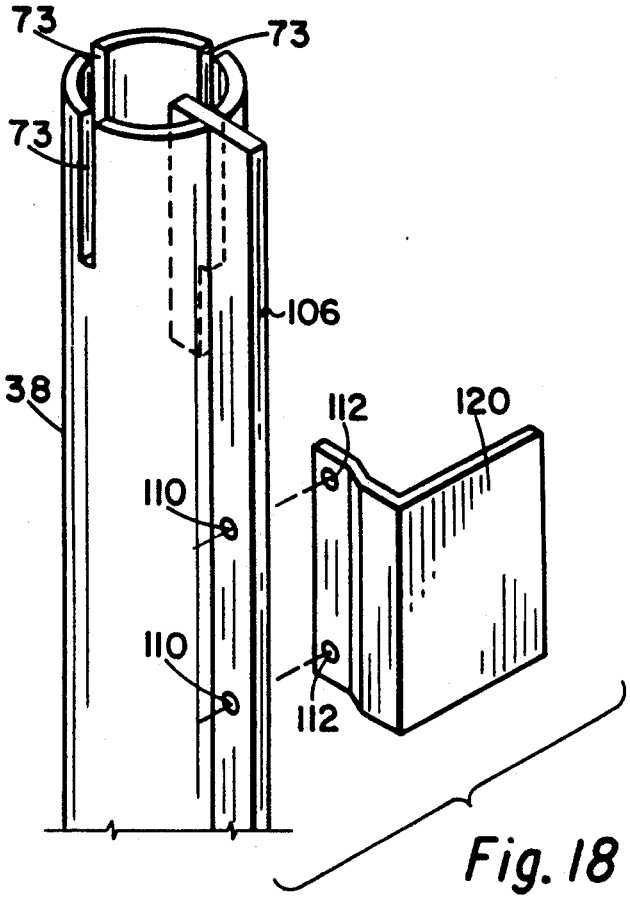
FIGS. 18 and 19 show the use of a hanger and alternate bracket suspended from a vertical pole assembly of the freestanding partition system shown in FIG. 1.
Figure 19:
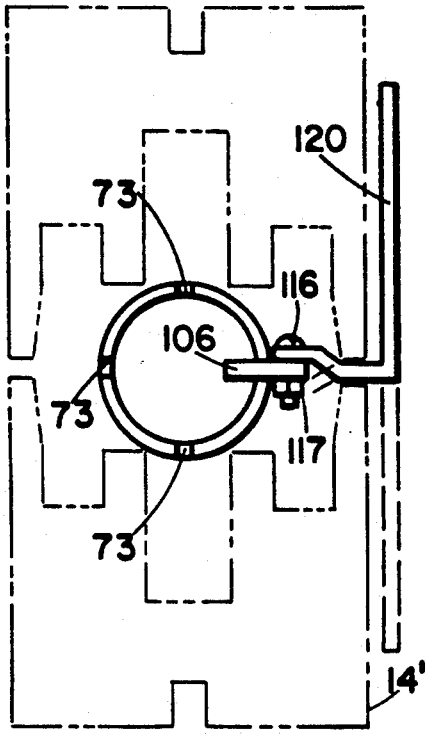

FIGS. 18 and 19 illustrate an alternate panel bracket 120 which would be primarily used for panel assemblies 14 that are aligned or "straight-run". As best seen in FIG. 18, the hanger 106 is received in slot 73. The hanger bracket 120 is attached to hanger 106. Hanger openings 110 will mate with bracket openings 112. As seen in FIG. 19, bolts 116 and nuts 117 fasten the hanger 106 to the bracket 120.

As will be appreciated, the bracket may be fastened at any vertical location on the hanger by changing the location of openings 110.

Figure 20:
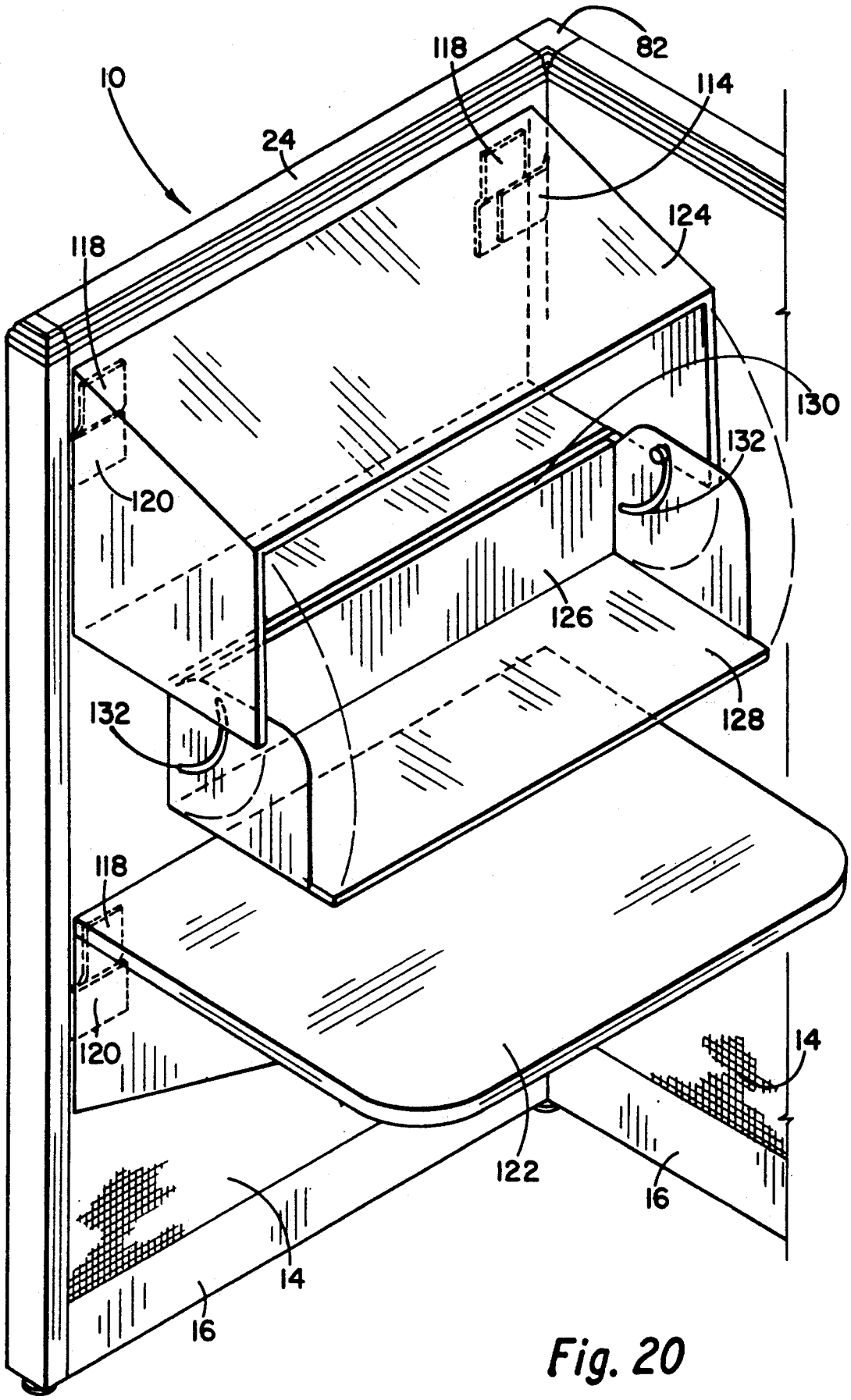
FIG. 20 is a perspective view of a freestanding partition system having a desk unit and storage unit suspended from hangers.

FIG. 20 illustrates two of the possible use of the hanger and hanger bracket arrangement described. A pair of hanger brackets 114 and 120 (only one shown in FIG. 20) are installed at the same vertical height. A pair of tongues 118 (only one visible in FIG. 20 in dashed lines) extend from a desk unit 122. Once the tongues are inserted in the space between the brackets and the panel assembly, the desk unit 122 will be both supported by and attached to the partition system.

Also seen in FIG. 20 is a storage unit 124 suspended in the same manner. A pair of brackets 114 and 120 extends from hangers (not seen in FIG. 20). The storage unit 124 has a pair of tongues 118 which fit in space formed by the brackets and the panel assembly.

Various types of storage units 124 may be utilized. In the embodiment shown, part of the base 126 and one wall 128 may be hinged to the unit by hinge 130. When in the open position as shown in FIG. 20, the wall 128 forms an additional shelf to hold items (not shown). Radial slots 132 and pins 134 act as guides to move the base and wall from open to closed position.

Other types of equipment and fixtures may be suspended in like manner.

Figures 21, 22:
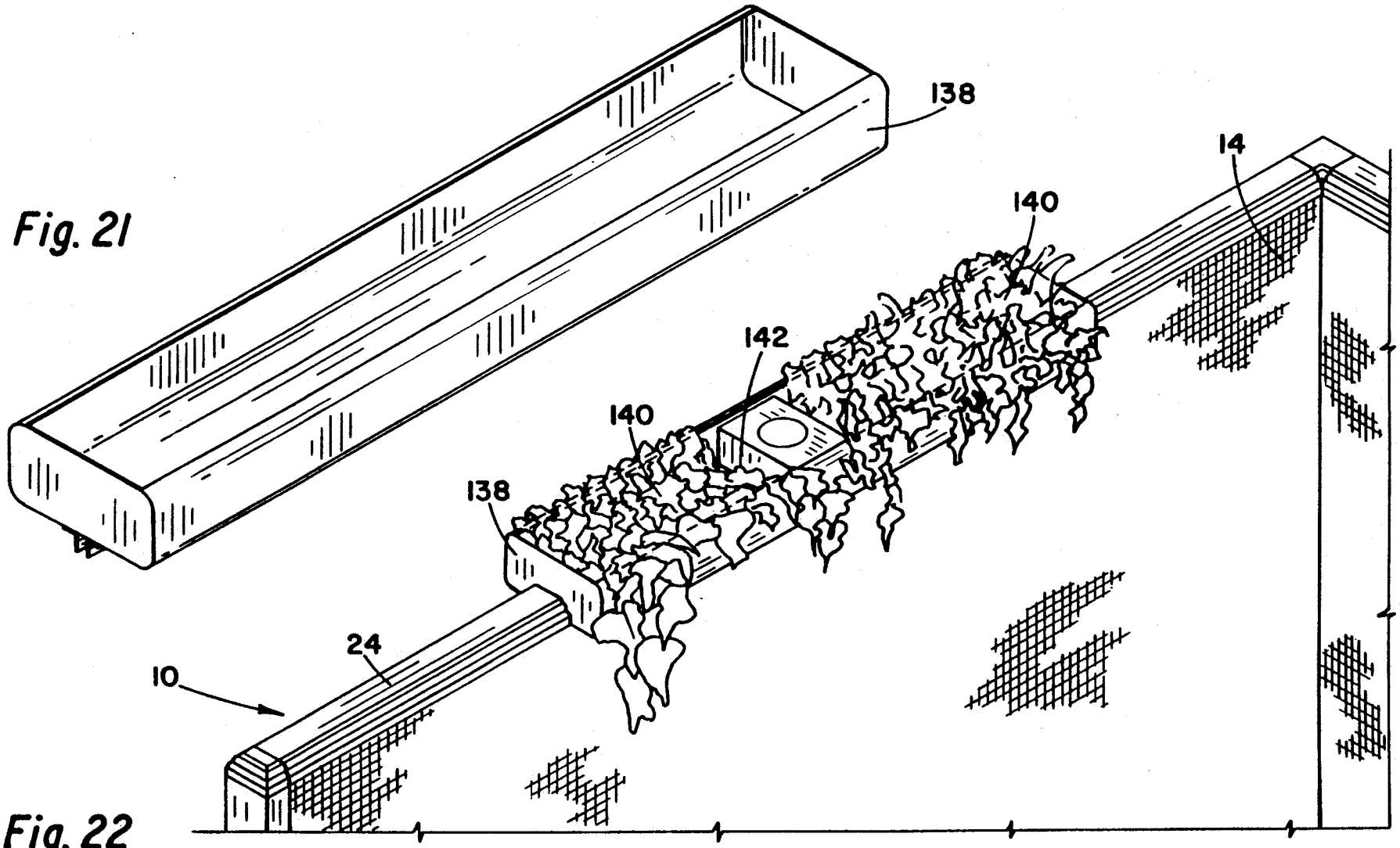
FIGS. 21, 22 and 23 illustrate a top mount through option for the freestanding partition system shown in FIG. 1.
Figure 23:
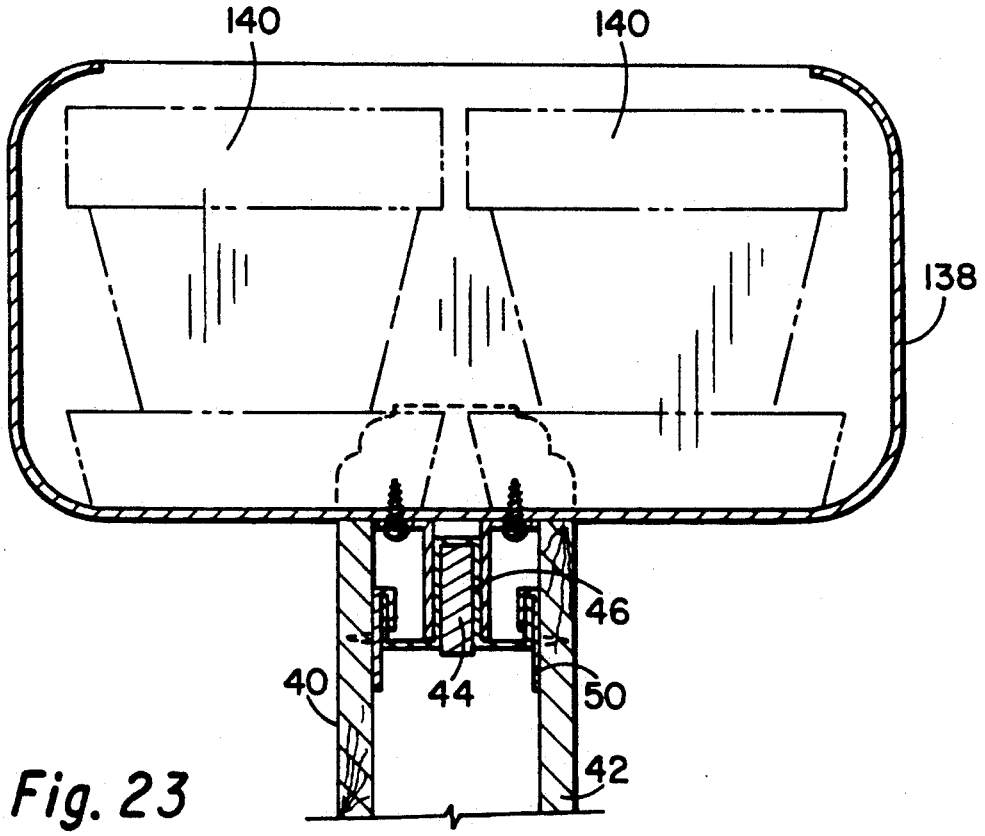

FIGS. 21, 22 and 23 show a solution to a problem encountered in open type partition systems. While a modular partition system maximizes the use of the space to house as much equipment and as many employees as possible, they can often be antiseptic and sterile looking. Additionally, lighting and acoustic problems have arisen. An optional panel top mount trough 138 which will lock into the partition system 10 is provided to address these problems. The trough provides an open top container and is shown in FIG. 21 apart from the partition system.

The trough 138 comes in various sizes and will be made to accommodate the various panel widths.

The trough includes wire management openings (not shown in the bottom of the trough). It will be recalled from the discussion concerning FIG. 2 that the panels 40 and 42 are spaced from each other so that a cavity is formed. Any electrical wiring will feed directly from the trough through the wire management openings to the cavity in the panel assembly and then to the power source. When the trough is to be used as a planter for live plants 140 (as shown in FIG. 22), the wire management openings are plugged with a plastic cap so that there is no water or moisture leakage from inside of the trough 138.

Acoustics in an office environment can affect efficiency, morale and productivity. Sound masking is a known procedure to address this problem. As seen in FIG. 22, a sound masking unit 142 may be incorporated within the trough 138. The sound masking unit is out of sight, easy to be moved when the freestanding partition system 10 is changed and easy to adjust the volume. If electric service is required, it may be provided in the manner described.

FIG. 23 shows a sectional view of the trough 138 (shown in section lines 23—23). The planter within the trough is shown in cross-section.

The trough 138 may also be used for indirect lighting. This allows the user an option of moving the fixture when the partition system is moved. Additionally, since the lighting is not a part of the fixtures, the owner retains the investment in the lighting.

Figure 24:
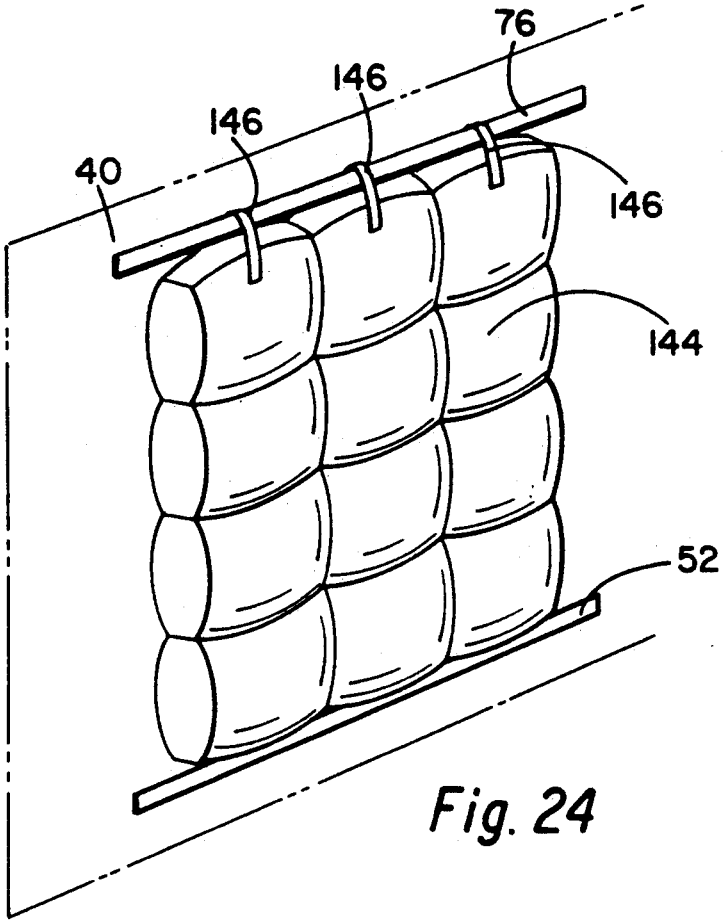
FIG. 24 illustrates an insulation option for use with the freestanding partition system shown in FIG. 1.

A further option on the partition system is shown in FIG. 24. When the double panel arrangement 42 is utilized, an acoustical blanket 144 may be used for insulation or sound deadening. The acoustical blanket 144 provides an economical solution for a sound absorbing element between work stations. The blankets would be installed at the time of assembly of the system and would be suspended from the upper rail 76. The blankets 144 are filled with a insulation material that fills the separate chambers or bags and provides an acoustical loft. Use of the separate bags within the blanket assure a consistent fullness which maintains an even acoustical value. The blanket 144 may be secured to the rail 76 by various methods including velcro straps 146 which will extend over the rail and connect back to the blanket. The straps 146 allow the blanket to hang in vertical position from the upper rail and above the base rail assembly. When the exterior panels 40 and 42 are installed, the acoustical blanket 144 will be slightly compressed, thus forcing the blanket to completely fill the interior cavity of the panel assembly 14.

A wide variety of layouts may be designed and assembled from these modular components.

Whereas, the present invention has been described in relation to the drawings attached hereto, it should be understood that other and further modifications, apart from those shown or suggested herein, may be made within the spirit and scope of this invention.

What is claimed is:

1. A freestanding partition system which comprises:
(a) upstanding posts capable or resting on a floor;
(b) at least one support rail means extending between adjacent posts and spaced from said floor;
(c) raceway means capable of hanging from said rail means, said raceway means includes a plurality of saddles hanging from said support rail means and tray means suspended from said saddles; and
(d) at least one panel assembly supported by said rail means.

2. A freestanding partition system as set forth in claim 1 including vertical pole means connected to each post and extending coaxially therewith, said vertical pole means having a slot extending axially to receive a hanger to suspend shelves or the like.

3. A freestanding partition system which comprises:
(a) upstanding posts capable of resting on a floor;
(b) at least one support rail means extending between adjacent posts and spaced from said floor;
(c) a plurality of saddles hanging rom said support rail means;
(d) tray means suspended from said saddles;
(e) vertical pole means detachably connected to each said post and extending coaxially therewith, wherein a pair of adjacent pole means and a support rail means define a panel receiving space; and
(f) at least one panel supported by said support rail means and receivable in said panel receiving space.

4. A freestanding partition system as set forth in claim 3 wherein each said upstanding post may be threadably connected to at least one of said support rail means in order to adjust the distance between said support rail means and said floor, thereby providing a levelling adjustment for said rail means.

5. A freestanding partition system as set forth in claim 3 wherein said support rail means includes a connecting bar secured to each said post and a rail extending between adjacent connecting bars.

6. A freestanding partition system as set forth in claim 3 wherein more than one connecting bar may be secured to a single post and said connecting bars will interlock.

7. A freestanding partition system as set forth in claim 3 including an additional upper rail means extending between adjacent vertical pole means parallel to said support rail means and forming a quadrilateral space with said pair of vertical pole means and said support rail means.

8. A freestanding partition system as set forth in claim 7 wherein said upper rail means supports a trough for plants, lights, acoustical equipment or the like.

9. A freestanding partition system as set forth in claim 7 wherein said upper rail means supports an acoustical blanket.

10. A freestanding partition system as set forth in claim 3 wherein said tray means includes a pair of parallel trays suspended from said saddles and defining two individual raceway ducts.

11. A freestanding partition system as set forth in claim 10 wherein said base covers are substantially parallel to and flush with the exterior of said panel.

12. A freestanding partition system as set forth in claim 11 including a cylindrical tree lock threadably connectable to said upstanding post.

13. A freestanding partition system as set forth in claim 11 wherein each said pole includes a vertical slot extending axially which will receive a hanger to suspend shelves or the like.

14. A freestanding partition system as set forth in claim 3 wherein said tray means includes a pair of base covers hingeably connected to said saddles wherein said base covers may be opened for access to said tray means.

15. A freestanding partition system as set forth in claim 3 wherein each said vertical pole means includes a key member receivable over said upstanding post.

16. A freestanding partition system as set forth in claim 15 wherein each said pole means includes a vertical pole connectable to said cylindrical tree lock.

17. A freestanding partition system as set forth in claim 3 including a plurality of panel brackets which may be suspended from said support rail means and wherein each said panel may be connected with and supported by said panel brackets.

18. A freestanding partition as set forth in claim 3 wherein said panel has grooves along at least three edges and wherein said grooves will mate with said support rail means and said adjacent vertical pole means.

19. A floor supported wall partition comprised of:

spaced upstanding posts supported upon said floor;

a lower connecting bar, each end of which is attached to said posts at a desired height above said floor;

a lower key member interconnected to each end of said lower connecting bar;

means supported by and below said lower connecting bar to form a utility raceway enclosure;

a vertical pole connected to each said lower key member;

a lock member attached to the top of said vertical pole;

an upper connecting bar each end of which is interconnected to said respective lock member;

means supported upon each said lower and upper connecting bars to receive and support a panel member to substantially occupy a space between said vertical poles and said connecting bar.

* * * * *